US006260240B1

(12) United States Patent
Akashi et al.

(10) Patent No.: US 6,260,240 B1
(45) Date of Patent: Jul. 17, 2001

(54) FASTENER WITH TAPE

(75) Inventors: Shunji Akashi; Kiyomasa Segawa, both of Toyama-ken (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 09/448,400

(22) Filed: Nov. 23, 1999

(30) Foreign Application Priority Data

Nov. 26, 1969 (JP) ..... 10-335728

(51) Int. Cl.[7] ..... A44B 17/00
(52) U.S. Cl. ..... 24/114.4; 24/662
(58) Field of Search ..... 24/114.4, 114.05, 24/114.8, 662, 629, 681, 682, 693, 92, 96, 104, 108; 425/520; 428/100, 99, 198

(56) References Cited

U.S. PATENT DOCUMENTS

| | | | | |
|---|---|---|---|---|
| 2,821,764 | | 2/1958 | Leahy et al. . | |
| 3,551,963 | * | 1/1971 | Mosher, Jr. et al. | 24/662 X |
| 3,800,368 | * | 4/1974 | Simon | 24/693 |
| 4,761,863 | * | 8/1988 | Sugihara | 24/114.4 X |
| 4,796,339 | * | 1/1989 | Burke | 24/662 |
| 4,805,272 | * | 2/1989 | Yamaguchi | 24/623 |
| 4,805,273 | * | 2/1989 | Burke et al. | 24/662 |
| 5,357,659 | * | 10/1994 | Ackermann | 24/114.4 X |

FOREIGN PATENT DOCUMENTS

| | | |
|---|---|---|
| 0 228 293 | 7/1987 | (EP) . |
| 0 943 255 | 9/1999 | (EP) . |
| 0 966 896 | 12/1999 | (EP) . |
| WO 88/00881 | 2/1988 | (WO) . |

* cited by examiner

*Primary Examiner*—Robert J. Sandy
(74) *Attorney, Agent, or Firm*—Finnegan, Henderson, Farabow, Garrett & Dunner, L.L.P.

(57) ABSTRACT

A fastener with tape has fastening members of synthetic resin molded integrally and firmly on front and rear surfaces of the tape so as to enclose an entire peripheral portion of a mounting hole of the tape having at least a mounting hole. The fastening members are made of synthetic resin material to which fine inorganic filler is added. The stiffness and the elasticity of the fastening members change depending on the kind and the addition amount of the inorganic filler. Therefore, when even if the melting point of the resin material for use is high so that a produced fastener can bear high temperature treatment but the stiffness and elasticity thereof are low, it is possible to provide a fastener with tape capable of not only bearing high temperature treatment but also having predetermined stiffness and elasticity, and also having an excellent wear resistance, by adjusting an amount of the inorganic filler to be added to the synthetic resin material

12 Claims, 10 Drawing Sheets

FASTENER WITH TAPE

BACKGROUND OF THE INVENTION

1. Field of the Invention

The present invention relates to a fastener with tape such as a snap fastener or an eyelet, and more specifically to a fastener with tape in which a plurality of fastening members or the like made of synthetic resin are mounted integrally on the same tape.

2. Description of the Related Art

This kind of fastener with tape has at least one mounting hole on a single tape, in which an eyelet or a male or female fastening member of a snap fastener, or other kind of fastening member, which is made of synthetic resin and has a desired conFIGuration, is molded integrally on front and rear surfaces of the tape so as to enclose an entire periphery of the mounting hole.

The method for producing such a fastener is disclosed in, for example, U.S. Pat. No. 2,821,764 and EP Patent No. 0228293. Further, the applicant of this patent application has already proposed such a fastener in Japanese Patent Application No. 10-138722 now copending U.S. application Ser. No. 09/306,168, filed May 6, 1999. The aforementioned U.S. Pat. No. 2,821,764 discloses that, for forming mounting holes on a sheet-like material and then molding an eyelet of synthetic resin having a desired shape on front and rear surfaces of the tape so as to hold an entire periphery of each mounting hole, each mounting-hole peripheral portions of the sheet-like material extending around the mounting hole is clamped and held at plural positions by plural pairs of pin members which protrude into a cavity for molding the eyelet, and then molten resin is introduced into the cavity so as to mold the eyelet of synthetic resin integrally onto the sheet-like material.

Generally, if no pin members are used in the molding, the mounting-hole peripheral portion of the sheet-like material extending in the cavity would be largely waved in a circumferential direction by an introduction pressure of molten resin. Therefore, at worst, a part of the peripheral portion is deflected to make contact with an inner face of the cavity, in which case the sheet-like material may be exposed from a part of a surface of the eyelet as a final product. The invention of the aforementioned US patent pays attention to the fact that appropriate waving of the mounting-hole peripheral portion of the sheet-like material induces an increase of fixing strength of the eyelet to the sheet-like material. To achieve such appropriate waving, the mounting-hole peripheral portion of the sheet-like material is clamped and held by the pin members so as to control a degree of such waving.

On the other hand, the manufacturing method as disclosed in the above EP Patent No. 0228293 is accomplished under the same technological concept as the aforementioned U.S. patent so as to prevent occurrence of excessive waving as described above. This European Patent is different from the aforementioned U.S. patent in the following point. While the molten resin is introduced from a center of an opening of the eyelet toward an inner peripheral portion of the cavity according to the U.S. patent, according to the European Patent, it can be estimated that the molten resin is not introduced from a center of an engaging opening of a female fastening member into the cavity, considering that upper and lower dies for the engaging opening of the female member are in firm contact along their parting line, as shown in FIG. 4 showing a typical example of the EP Patent.

The invention according to Japanese Patent Application No. 10-138722 is based on a molding principle of the aforementioned US patent like the aforementioned European Patent, but further has been largely improved to make it possible that not only male/female fastening members of a snap fastener but also an eyelet and other fastening member are securely made integral with a tape. Further, the invention made it possible to dispose such different fastening members arbitrarily on the same tape, and further to provide a single kind of fastening members with various colors and the same fastening members and mold the fastening members of different materials.

According to the invention of this Japanese Patent Application No. 10-138722, firstly a base portion of synthetic resin having an opening at a center thereof is molded integrally on front and rear surfaces of a tape so as to enclose an entire peripheral portion of a mounting hole in a tape having at least one mounting hole. Next, an engaging portion is mounted integrally via an intermediate member of synthetic resin at least along an inner peripheral face of the opening of the base portion, or without such an intermediate member.

However, what should be most noticed of the invention Japanese Patent Application No. 10-138722 is that the base portion is constructed separately from the engaging portion via an intermediate member or without an intermediate member. Generally, when the base portion is molded integrally on a mounting-hole peripheral portion of the tape, appropriate waving generated in the mounting-hole peripheral portion of the tape is favorable because this improves a fixing strength between the tape and base portion, as described in the U.S. patent.

According to the invention of Japanese Patent Application No. 10-138722, the base portion is molded integrally directly on the tape by improving the aforementioned US patent method, and the engaging portion is molded integrally to the opening of the base portion molded on the tape or an opening of the intermediate member appropriately in a demanded form. The base portion can be molded freely without being restricted by a shape or material of the engaging portion as far as it has an opening. Therefore, a basic shape of the base portion can be commonly applied to diversified conFIGurations of the engaging portions. Thus, it is possible to manufacture a large number of tapes on which a number of base portions having the same conFIGurations are molded integrally, and then to integrally mount a necessary number of engaging portions having required shapes on the base portions at the same time or individually.

Meanwhile, this kind of fastener with tape, particularly the snap fastener, is demanded to have not only economic performance, but also its required characteristic, namely appropriate stiffness and elasticity. As material having such a characteristic, polyacetal resin is most suitable and therefore generally used, buts as a rare case, nylon or polybutylene terephthalate is used.

On the other hand, because it has become possible to effectively mold fastening members having various shapes and characteristics due to a progress of the molding technology, application field thereof has been expanding. Therefore, although the application of conventional fastener with tape was restricted to, for example, baby clothes or products not requiring heat treatment under high temperature after use such as under wears and bags, the application field thereof has been expanding to ordinary clothes, and further to other various fields.

Such expansion of the application field cannot be accomplished by only improvement of the molding technology, so there has occurred a problem particular to such application field. Particularly if this kind of the fastener is employed in ordinary clothes, large-step improvement of durability capable of bearing repeated use is demanded to the fastener, considering economic performance, and development of material capable of bearing heat treatment under high temperature is demanded.

Under such circumstance, polyacetal resin, which has appropriate stiffness and elasticity as an engaging/disengaging device, has been generally used. However, it has not met diversification of applications of the fasteners because its softening temperature is low and it is softened easily at about 170° C. For example, when a fastener with tape made of polyacetal resin is affixed to ordinary clothes, this fastener is deformed easily by pressing with a household electronic iron, so that not only a function of the fastener is lost easily, but also an appearance thereof is damaged. Further, engaging/disengaging operation of the fastener of ordinary clothes is carried out more frequently than products conventionally provided with this kind of the fastener, and therefore the durability thereof needs to be increased by far more than it was.

If considering nylon or polybutyl terephthalate, which is seldom used as this kind of the fastener, its melting point thereof is high so that they can bear heat treatment by a household iron or the like, but they are not sufficiently useful as this kind of the fastener from the standpoints of elasticity and stiffness. The stiffness of polyacetal resin is 25,000 kg/cm$^2$ or more and the elasticity thereof is 15,000–45,000 kg/cm$^2$, however, values of nylon soaked with water are by far lower than those values.

Usually, in case of this kind of fastener, if its stiffness is too low, a fixing strength of the fastener integrally molded to the tape becomes weak so that in use, it is easily detached from the tape. If the elasticity thereof is low, engaging force between the male and female fastening members becomes weak so that they are easily disengaged from each other. On the other hand, considering wear resistance, portions of the male and female engaging portions, that is, a stud portion of the male portion and a socket portion of the female portion that are integrated with the tape, are desired to be made of homogeneous materials.

For example, in case of a snap fastener, if nylon is used for a male fastening member and polyacetal resin is used for the female fastening member, and if engaging/disengaging operation is repeated, a surface of the stud portion of the male fastening member is worn out in a relatively short time, so that its engaging/disengaging function is largely reduced. Therefore, generally, it is preferable to use synthetic resin of homogeneous material for the male and female fastening members in viewpoint of improvement of durability.

SUMMARY OF THE INVENTION

Accordingly, an object of the present invention is to provide a fastener with tape which is prevented from being deformed during treatment like pressing under high temperature, has appropriate stiffness and elasticity, and has an excellent wear resistance.

Such an object is accomplished effectively by the present invention as described below.

According to the present invention, there is provided a fastener with tape in which fastening members of synthetic resin molded integrally on front and rear surfaces of the tape, the fastening members being made of synthetic resin to which fine inorganic filler is added.

Because application field of this kind of fastener with tape has been diversified in recent years, it has become unsatisfactory only to produce a fastener by using synthetic resin having excellent stiffness and elasticity as it was. Further, it has been demanded to achieve development of a fastener with tape which is not deformed by treatment like pressing under high temperature, has appropriate stiffness and elasticity, and having excellent wear resistance.

To meet this demand, the inventors of the present invention considered this problem in many aspects. As a result, it was found that synthetic resin material alone cannot meet the aforementioned demand with economic performance being satisfied and then, carried out a number of experiments about composite resin. Consequently, by adding other material to synthetic resin material generally having a high melting point, the inventor of the present invention succeeded in development of material having the same stiffness and elasticity as prior art and further having a resistance to high temperature and excellent durability against repeated engaging/disengaging operation.

Here, it was found that particularly inorganic material was effective as a material to be added to synthetic resin material. Further, this inorganic filler is preferably of minute fiber state (including a whisker state). Although various kinds of metallic fibers, ceramic fiber, glass fiber, carbon fiber, alamide fiber or the like are possible to be employed, this inorganic filler may be in other diversified states such as particulate state or powder state. Then, the state and size of the material may be selected appropriately from the aforementioned materials depending on the kind of synthetic resin which is to be a main component of the fastener.

The synthetic resin material to which such inorganic filler is to be added and which is a main component of the fastener of the present invention may be any thermoplastic synthetic resin as far as it is used for an ordinary molded product, such as of polyethylene system, polyester system, polyamide system, polypropylene system, polystyrene system, polyurethane system, polyvinyl system, polyacetal system or the like. Of these synthetic resins, particularly nylon 6 (melting point of 215–225° C.), nylon 66 (melting point of 253–263° C.) or polybutylene terephthalate (melting point of 224–230° C.) is preferable. On the other hand, the tape as mentioned here refers to those including every kind of woven fabric and knitted ones, unwoven cloth, various synthetic resin films or sheets, or tapes formed of natural or synthesized leather. Further, the material of these tapes may be either natural or synthesized.

Because the fastener with tape of the present invention has a feature in material of the fastener as described above, it includes a case in which a mounting hole for the fastener is formed in a tape preliminarily and the fastener is mounted integrally on front and rear surfaces of the tape so as to enclose an mounting-hole peripheral portion, as well as a case in which the fastener is molded integrally on a surface of the tape without forming a mounting hole.

Further, according to the present invention, it is preferable that a melting point of the synthetic resin to which the fine inorganic filler is added is 180° C. or higher, in which elasticity thereof is about 15,000–45,000 kg/cm$^2$ and stiffness thereof is 25,000 kg/cm$^2$ or more. If the softening temperature is below 120° C., the fastening member is softened and deformed easily by ironing at home, for example, although this event partly depends on the tape material. If the elasticity is less than 15,000 kg/cm$^2$, the fastener is elastically deformed too easily. If it exceeds 45,000 kg/cm$^2$, the engaging/disengaging operation cannot be performed easily, so that a function of the engaging/disengaging device is not satisfied. On the other hand, if the stiffness is less than 25,000 kg/cm$^2$, the fastener is so soft that the fixing strength thereof to the tape by molding is decreased, thus it may be removed from the tape easily.

Furthermore, according to the present invention, it is preferable that the inorganic filler is fiber-like, and the fiber length thereof is 0.1 mm or less. The inorganic filler may be in particulate or powder state and its state is not restricted to a particular one. However, to increase the stiffness and elasticity (spring property) of the synthetic resin molded product, the fiber state is favorable because it allows to obtain a preferred dispersion state (intersecting condition) in the synthetic resin material.

Still further, it is preferable that an amount of the inorganic filler to be added to the synthetic resin material is 4–30 wt % with respect to total weight of the synthetic resin. As a result of experiments by the inventor of the present invention, it was found that physical property of the synthetic resin changes largely depending on the addition amount of the inorganic filler. Particularly if the addition amount is less than 4 wt %, an effect of the addition of the inorganic filler is not exerted sufficiently so that only a low elasticity is ensured. Thus, the fixing force as an engaging/disengaging device is so weak so that the function of the fastener is not exerted sufficiently. Further, because the stiffness is so small, a sufficient fixing strength of the fastening member to the tape cannot be obtained. On the other hand, if the addition amount exceeds 30 wt %, the stiffness increases remarkably and the fixing strength to the tape is increased, but the engaging/disengaging operation is made difficult. However, if the addition amount is 5–15 wt % with respect to the total weight of the synthetic resin as described above, preferable stiffness and elasticity of the fastener can be obtained.

According to the present invention, each fastening member is composed of a base portion molded integrally on front and rear surfaces of the tape so as to enclose an entire peripheral portion of the mounting hole in the tape and an engaging portion which engage with and disengage from a mating fastening member. The engaging portion is molded at the same time when the base portion is molded so that the engaging portion is integral with the base portion.

The present invention specifies a manufacturing method for the fastener on a presumption that raw material of the fastening members is composed material of synthetic resin and inorganic material. Usually, this kind of the fastening member comprises a base portion which is fixed to a tape and an engaging portion which engages with and disengages from a mating engaging portion. The present invention employs the same general molding method as the aforementioned US patent and the European patent in which the base portion and the engaging portion are molded in the same cavity at the same time. Therefore, in the fastener with tape according to the present invention, its base portion and engaging portion are molded of the same material.

In this case, it is preferable that an amount of the inorganic filler to be added to the synthetic resin material is 8–15 wt % with respect to the total weight of the synthetic resin material so as to ensure necessary stiffness as well as elasticity at a minimum as a fastener. When the addition amount of the inorganic filler to be added to the synthetic resin is within this value, the stiffness and elasticity necessary for a fastener are given regardless of the kind of the resin material that is generally a main component of a fastener. Further, because the base portion and the engaging portion are composed of the same material, even if the engaging/disengaging operation is carried out repeatedly, there occurs little wear and the durability is ensured.

According to the present invention, each of the fastening members may be composed of a base portion formed integrally on front and rear surfaces of the tape so as to enclose an entire peripheral portion of the mounting hole in the tape, the base portion having an opening in a center thereof, and an engaging portion which is mounted integrally on the base portion at least along an inner peripheral face of the opening of the base portion and which engage with/disengage from a mating fastening member.

The present invention is characterized in that the base portion of the fastening member is molded integrally on the tape and then the engaging portion is mounted along an opening periphery of the base portion. Specifically, there are a case in which the base portion and the engaging portion are made of the same material, as well as a case in which they are made of different materials. Further, the present invention not only specifies a shape of the base portion but also includes a case in which the mounting of the engaging portion to the base portion is not always fixed by integration but both the portions may be mounted rotatably relative to each other. This is particularly effective when the base portion and the engaging portion are molded of synthetic resins having no affinity between the two. Therefore, this is caused from the fact that the present invention is based on a completely novel molding method, not on any conventional molding method, for this kind of fastener.

Picking up one example of this mounting method, after the engaging portion is molded independently, the engaging portion is inserted into an opening of the base portion and then the engaging portion is pressed by means of a heating body so as to heat and deform a part of the engaging portion, so that the engaging portion is rotatably fit into the opening. For example, if the engaging portion is an engaging portion of the male fastening member, the engaging portion is inserted into a central opening of the ring-like base portion. After that, an insertion end portion of the engaging portion is pressed and plastically deformed by heat, so that the engaging portion is slidably fit into the opening. According to the fastener manufactured in this manner, even if an engaging direction of a fastening member is different from that of an adjacent fastening member when the male fastening members are engaged with the female fastening members which are mating fastening members of a snap fastener, the engaging direction can be adjusted easily after all the engagements are completed. This is a novel function which cannot be expected by a method in which the engaging portions are completely fixed to the base portions.

In this case, it is preferable that the engaging portion is mounted integrally by insert molding after the base portion is molded. That is, according to the present invention, the engaging portion is mounted integrally on the base portion by molding. This molding is carried out by an ordinary insert molding method, in which after the base portion molded integrally on the tape is set together with a tape in a molding die for the engaging portion, the engaging portion is molded by injection molding. When the base portion is molded, the tape is clamped and held by clamping pieces at peripheral portions of the mounting hole on the front and rear surfaces of the tape in a cavity of a molding die, and molten resin is introduced into an inner peripheral face of the cavity through a guide path for guiding the molten resin radially or linearly. As a result, the molten resin material is supplied equally without waving the mounting-hole peripheral portion of the tape. At this time, it is preferable to mold the engaging portion integrally along the periphery of the opening of the base portion, with a molded path molded in the opening of the base portion being broken and separated or being left. In case where the molded path is broken and removed so that the breaking burr is left on an inner peripheral face of the opening of the base portion, which makes the breaking burr exist on an interface between the base portion and the engaging portion. In case where the molded path is left on an inner peripheral face of the opening of the base portion, it is buried inside the engaging portion engaged with the base portion. Thus, in either case, the fixing strength between the base portion and engaging portion is increased.

According to the present invention, the base portion and the engaging portions may be molded independently, and both the portions may be mounted with a mounting means. As regards the mounting method, after the engaging portion molded preliminarily is inserted into the opening of the base portion, the engaging portion is pressed by means of a high temperature member, and a part of the engaging portion is melted and deformed by that pressing force and heat, so that the engaging portion is fused to and integral with the opening. Alternatively, instead of the aforementioned fusing, the engaging portion molded preliminarily may be inserted into the opening of the base portion and then a part of the engaging portion may be pressed by ultrasonic wave or high frequency heating means so as to melt and deform the engaging portion, thereby making the engaging portion fused to and integral with the opening. Alternatively, they may be bonded to each other with adhesive agent.

Further, according to the present invention, it is preferable that the synthetic resin raw materials of mating engaging portions of the fastening members such as male and female are of the same organic resin system. The reason is that if the synthetic resin materials of the mating engaging portions are composed of the same organic material systems, the wear resistance is ensured and the durability is improved. At this time, the base portion to be fixed to the tape may be molded of organic material different from that of a stud portion which is an engaging portion of the male fastening member or an engaging portion of the female fastening member which engages with/disengages from that stud portion.

In this case, it is preferable that an addition amount of the inorganic filler to the base portion is 15 wt % or more with respect to the total weight of the synthetic resin material and an addition amount of the inorganic filler to the engaging portion is 4–15 wt % with respect to the total weight of the synthetic resin material.

This is for the base portion of the fastener to ensure a fixing strength by integral molding relative to the tape. For that reason, the amount of the inorganic filler to be added to the synthetic resin needs to be 15 wt % or more with respect to the total weight of the synthetic resin because a sufficient stiffness is required. On the other hand, because the engaging portion requires some extent of stiffness and appropriate elasticity, the amount of the inorganic filler to be added to the synthetic resin is preferably 4–15 wt % with respect to the total weight of the synthetic resin. If the inorganic filler is in this range, necessary stiffness and elasticity as the engaging portion of the fastener can be obtained.

According to the present invention, without adjusting the amount of the inorganic filler to be added to the synthetic resin as described above, it is possible to adjust the stiffness and the elasticity. Specifically, based on a fact that a difference occurs in the stiffness and the elasticity depending on the kind of the inorganic filler even if the same synthetic resin material is used, it is possible to make such adjustment by adding different inorganic fillers to the base portion and the engaging portion respectively.

DESCRIPTION OF THE PREFERRED EMBODIMENTS

A prominent feature of a fastener with tape according to the present invention is that the fastener with tape has fastening members made of synthetic resin and molded integrally on front and rear surfaces of the tape, and material composing the fastening members is specified. More specifically, the composing material is obtained by adding minute inorganic filler to thermoplastic synthetic resin material having a high melting point. As a result of use of such material, not only stiffness and elasticity are satisfied like in the prior art, but also this material is capable of bearing heat treatment under high temperature and further, repeated engagement/disengagement for a long term sufficiently. Consequently, there is such a remarkable advantage that the fastener of the present invention can be used for ordinary clothes in which the fastening members may be subjected to heat treatment under high temperature repeatedly, and frequent engagement/disengagement operations.

Although this is not indispensable requirement of the present invention, as an embodiment for fixing the fastener on a tape, there are two cases: one is that a mounting hole for the fastening member is formed preliminarily in a tape and then the fastening member is molded integrally on the front and rear surfaces of the tape so as to enclose a periphery of the mounting hole, and the other is that the fastening member is directly molded integrally on a surface of the tape without forming a mounting hole. In case where the mounting hole is formed, a base portion which is molded integrally on the tape and an engaging portion to be engaged with and disengaged from a mating fastening member are molded independently, and then the both parts are installed integrally with each other, which is a remarkable point on which special attention should be paid. Of course, the present invention includes a case in which the base portion and the engaging portion are molded integrally at the same time as in the prior art.

In a method in which the base portion and the engaging portion for engaging with and disengaging from a mating fastening member are molded separately and independently, and then both the parts are mounted integrally, an opening should be made in a center of the base portion, then this base portion can be used even if a shape or material of the engaging portion is changed. This makes it possible to mount even the male engaging members and female fastening members, which are different in configuration, integrally on a single tape at the same time or separately with a necessary quantity and arrangement. Further, the engaging portion can be made of different material and with a different color from the base portion. These features could not be achieved in a conventional fastener with tape.

The above features of the present invention are made evident from description of the embodiment which will be made below.

Figure 1:
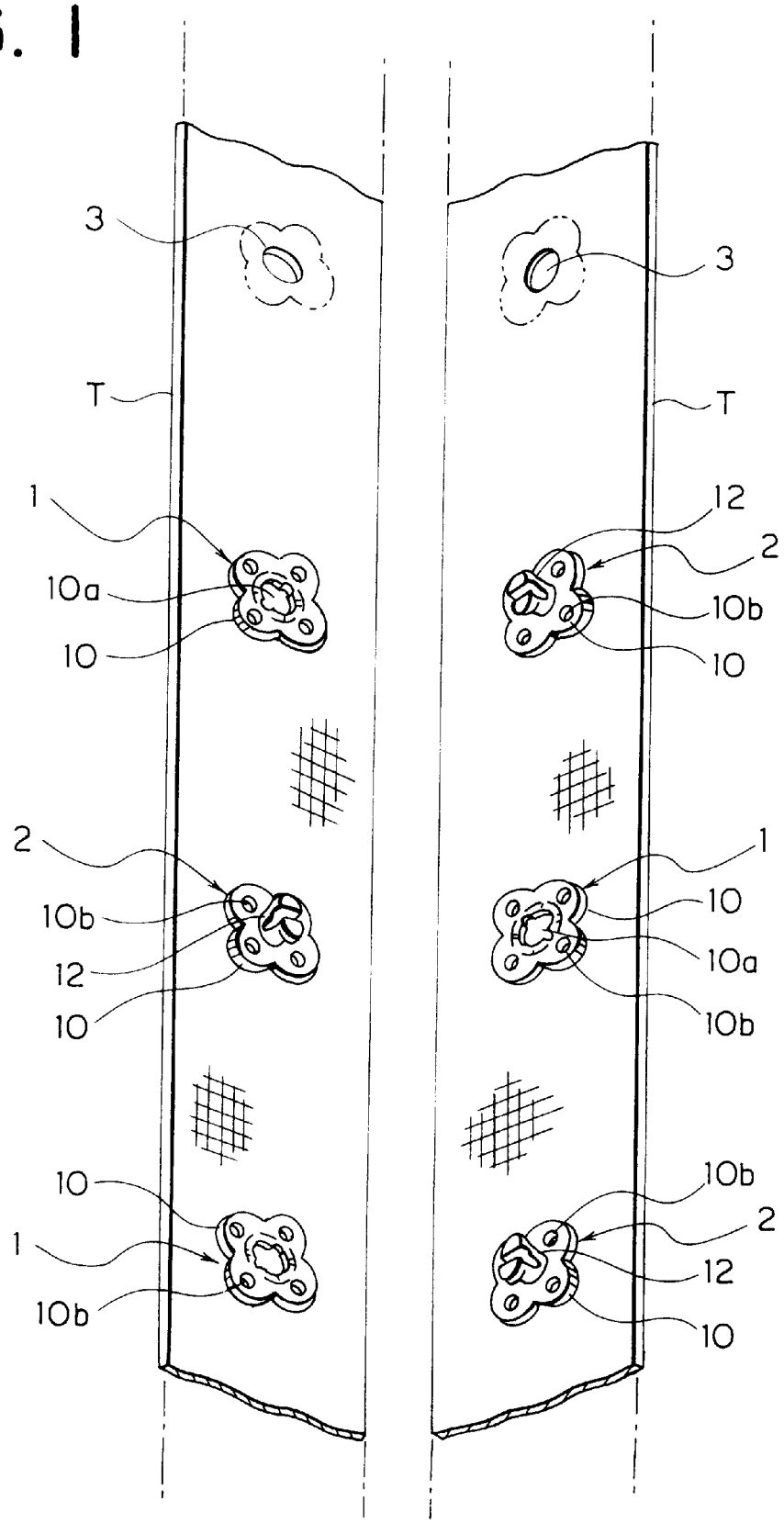
FIG. 1 is a partial perspective view showing an embodiment of a fastener with tape in which female and male fastening members are arranged alternately on a single tape and fixed thereto according to the present invention.

Hereinafter, a snap fastener, which is a typical embodiment of a fastener with tape according to the present invention, will be described with reference to the accompanying drawings. FIG. 1 is a perspective view of a first embodiment showing a male fastening member and a female fastening member of the snap fastener with tape according to the present invention, the male fastening member and female fastening member being mounted in parallel and integral to the tape.

The fastener with tape of the present invention is not restricted to the aforementioned snap fastener, but it can be the other type of fastener, an eyelet, tieback for curtain opening/closing or the like. A basic principle of a method for manufacturing the snap fastener with tape according to this embodiment is based on a manufacturing method in which a mounting hole for the fastener is formed preliminarily, as proposed in the aforementioned Japanese Patent Application No. 10-138722. However, the present invention includes a case in which the fastener is directly molded integrally on the surface of the tape without forming an mounting hole.

That is, according to this embodiment, as shown in FIG. 1, a plurality of mounting holes 3 are formed on a long tape T with a predetermined interval, then the tape T is supplied in a molding die, and a ring-like base portion 10 which is one of components of a female fastening member 1 and/or a male fastening member 2 is molded integrally on the front and rear surfaces of the tape T. Here, the base portion 10 composes a base member according to the present invention. In molding the base portion 10, tape supporting members (pins) are provided so as to protrude to confront with each other inside of a base-portion-molding cavity of the molding die like the molding technology disclosed in the aforementioned U.S. patent specification. In a state that the dies closed and the periphery of the mounting hole 3 in the tape T clamped and held by the tape supporting members from the front and rear surfaces of the tape, molten resin is introduced toward the periphery of the mounting hole 3 through a center of the mounting hole 3, substantially parallel to the tape T. At this time, the resin introducing pressure is distributed equally to the front and rear surfaces of the tape T, so that the base portion 10 of synthetic resin is firmly fixed to the periphery of the mounting hole 3, while appropriate waving phenomenon is generated in the peripheral tape portion of the mounting hole 3, and consequently molded integrally with the tape T.

Figure 10:
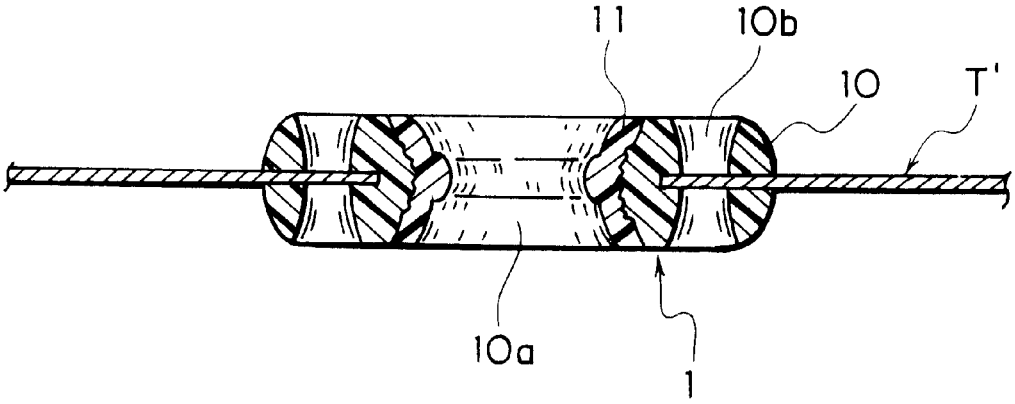
FIG. 10 is a sectional view of a fastener with tape in which a female engaging portion is molded integrally along an opening of the base portion.

In an example shown here, an inner peripheral face of the opening 10*a* in the center of the base portion 10 has a form of an ordinary female engaging/disengaging face and therefore, the base portion 10 comes to compose a female fastening member without mounting another female engaging portion, as shown in FIG. 10. Then, the male engaging portions 12 are molded integrally alternately to the base portions 10 molded at the same pitch in a length direction of the tape T and having common configurations. As a result, the female fastening members 1 and the male fastening members 2 are mounted alternately on the same tape T. Such a structure could not be accomplished effectively by a conventional technology, and this embodiment enables to produce male fastening members 2 using a conventional ordinary female fastening members with tape.

Figure 2:
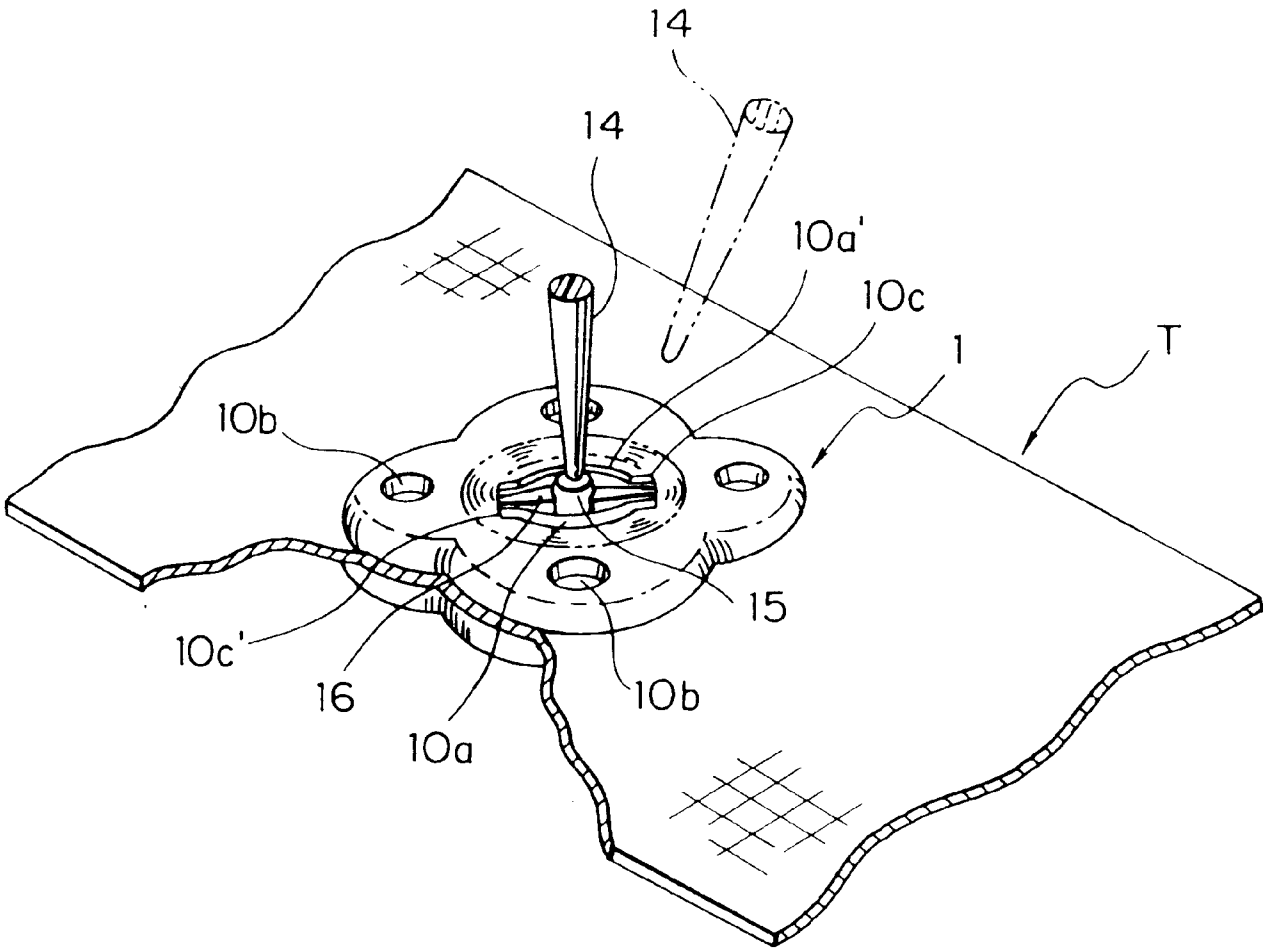
FIG. 2 is a partial perspective view showing an example of a female fastening member with a base portion in a molding die according to the embodiment.

FIG. 2 shows a typical example of a tape with base portion according to this embodiment, just after a base portion 10 is molded integrally on peripheral portions of the front and rear surfaces of the mounting hole 3. In this Figure, a molded runner 14 and a molded gate 16 remain in a center of the base portion 10, so that an opening 10*a* has not yet been formed completely. Speaking of this molded configuration concretely, an outer shape of the base portion 10 is an flower-shaped configuration as a whole in which four arc-shaped portions are joined at their outer peripheries. The opening 10*a* is provided in the center of the flower shape. In the middle of the flower shape in the thickness direction thereof, the mounting hole 3 of the tape T extends to near the periphery of the opening hole 10*a*, such that the base portion 10 is fixed integrally on the tape T so as to hold the tape T with the mounting hole 3 being as a center. Further, four molding holes 10*b*, which are formed by tape supporting members provided so as to protrude in the cavity extending in a front-rear surface direction of the tape T, are molded such that the tape T extends between each pair of the tape supporting members.

In the base portion 10 molded according to this embodiment, the molded runner 14 and the molded gate 16 are molded at the same time by a molten resin passage composed of a runner 103*a*, sub-runner 103*b* and a gate 106 (see FIG. 6) of the molding die. Each of ends of the molded gate 16 is joined to substantially a center of a bottom face 10*c′* of a concave portion 10*c* formed in an inner periphery of the opening 10*a* in the center of the base portion 10. The molded runner 14 is automatically broken and separated from the molded gate 16 when the molding dies are opened, which will be described later. Further, the molded gate 16 joined to the base portion 10 is automatically broken and removed when the male fastening member 2 is engaged, which will be described later, so that the opening 10*a* having a complete shape is formed.

Figure 3:
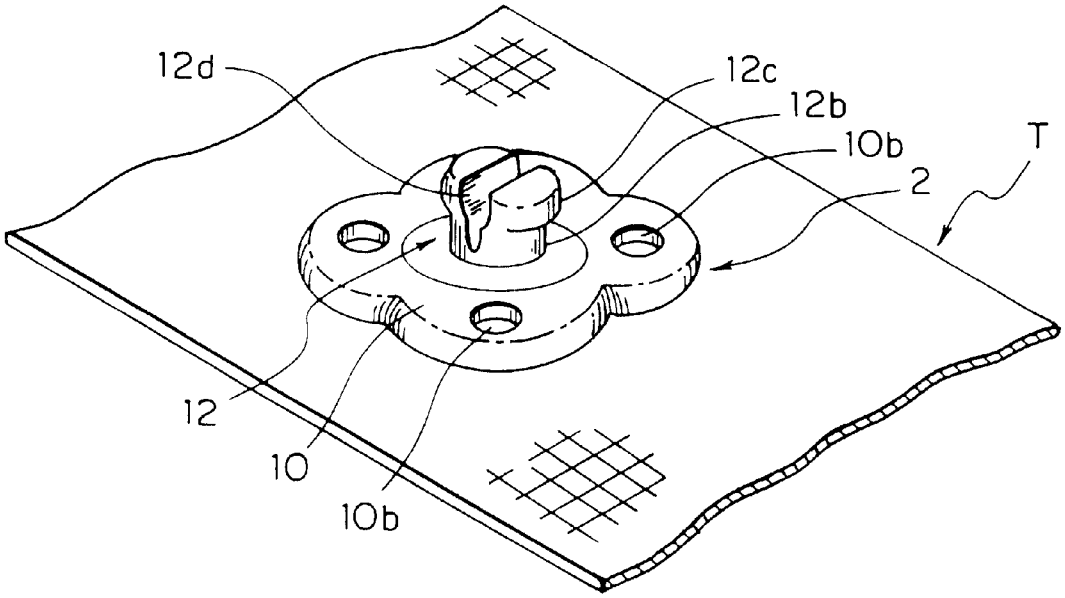
FIG. 3 is a partial perspective view of a male fastening member with tape in which a male engaging portion is molded integrally on the base portion of the female fastening member.
Figure 4:
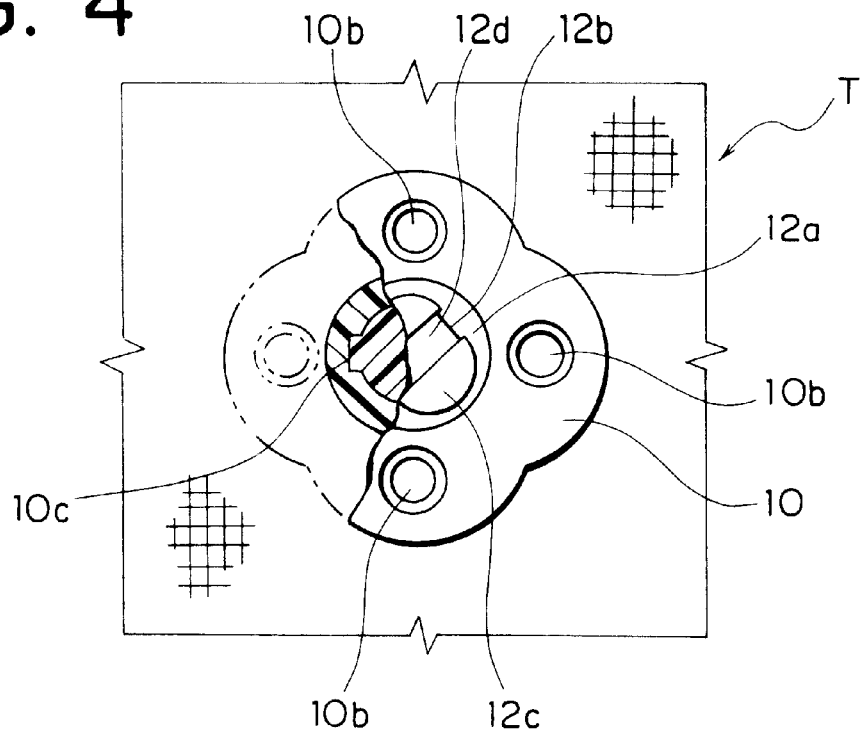
FIG. 4 is a plan view of the same male fastening member.

FIGS. 3 and 4 show a structure of the male fastening member 2 with tape according to this embodiment, which is mounted integrally on the tape T. As understood from this Figure, the male fastening member 2 comprises a base portion 10 and a male engaging portion 12. In this example, the male engaging portion 12 comprises a base portion 12*a* which engages the opening 10*a* of the base portion 10 integrally, a column portion (stud portion) 12*b* standing from the same base portion 12*a* and an engaging head portion 12*c* formed on an end of the column portion 12*b*. According to this embodiment, the column portion 12*b* and its engaging head portion 12*c* are both divided into two parts by a dividing groove 12*d* formed from halfway of the column portion 12*b* up to an end of the engaging head portion 12*c* in the axial direction thereof. According to this embodiment, the male engaging portion 12 having such a structure is inserted into the opening 10*a* of the base portion 10 so as to be integrally molded therewith.

According to this embodiment, nylon 6, nylon 66 or polybutylene terephthalate is used for the base portion 10 and male engaging portion 12 of the male fastening member 2 considering heat resistance. Also, the filler to be added to the synthetic resin of the base portion 10 of the male fastening member 2 and the male engaging portion 12, which is a characteristic feature of the present invention, is made of the same kinds of materials. Considering physical property uniformity, wear resistance and dispersion as a molded product, it is preferable to use fiber-like kalium titanate which is not just powder but is 1 mm or less in length, preferably 10–35 $\mu$m and has a diameter of 0.3–0.7 $\mu$m. Further, as the inorganic filler, in addition to the aforementioned kalium titanate, for example, carbon fiber, glass fiber, alamide fiber, fiber-like calcium silica, alumina, silicone carbide or the like can be used. A fiber length or particle diameter thereof is 1 mm or less, preferably below 100 $\mu$m.

This kind of the fastener needs an appropriate stiffness and elasticity (spring property). As regards this point, nylon 6, nylon 66 and polybutylene terephthalate have low stiffness. Generally, the stiffness of this kind of the fastener needs to be 25,000 kg/cm$^2$ or more and the elasticity needs to be in a range of 15,000–45,000 kg/cm$^2$. The nylon 6, nylon 66 or polybutylene terephthalate after soaked with water of 3–5% has stiffness and elasticity below the aforementioned values if no inorganic filler is added, which is inappropriate for this kind of fastener.

In particular, for the male snap fastener, the elasticity of the stud portion needs to be at least 15,000 kg/cm$^2$ from standpoint of engaging/disengaging force, while the stiffness needs to be at least 25,000 kg/cm$^2$ from standpoint of fixing strength to the tape T. These values are largely affected by an amount of the inorganic filler to be added to the synthetic resin as described above and generally, as the amount of filler is increased, both the values increase. Therefore, according to the present invention, by adjusting the material and the amount of the inorganic filler to be added corresponding to the kind of the thermoplastic synthetic resin, a desired stiffness and elasticity can be obtained.

To obtain such stiffness and elasticity necessary for the fastener, it is necessary to add the inorganic filler in a range of 4–30 wt % with respect to a total amount of the synthetic resin. Further, to ensure a fixing strength to the base portion 10, preferably the amount of the inorganic filler is 5 wt % or more. To ensure a elasticity equal to polyacetal resin, preferably the amount of the inorganic filler to be added is 16 wt % or less.

In case where the base portion 10 and male engaging portion 12 are molded separately like this embodiment, the amounts of the inorganic fillers to be added thereto can be made variant. For example, as for nylon 6, desired stiffness can be ensured by making the amount of the inorganic filler to be added to be 15 wt % with respect to the total resin of the base portion 10, while desired elasticity can be ensured by making the amount of the inorganic filler to be 8 wt % with respect to the total resin amount of the male engaging portion 12. As evident from the previous description, if the amount of the inorganic filler is 8–15 wt %, both the stiffness and elasticity are satisfied. Therefore, in this case, if the organic resins of the same system to which the same amount of the inorganic filler is added can be used for the base portion 10 and the male engaging portion 12, functions of the fastener can be sufficiently exerted.

The fastener with tape obtained in the above manner can not only withstand heat treatment under high temperature sufficiently and but also have appropriate stiffness and elasticity. Therefore, this fastener can be applied to ordinary clothes and other fields, which were difficult to be applied to in the prior art.

Figure 5:
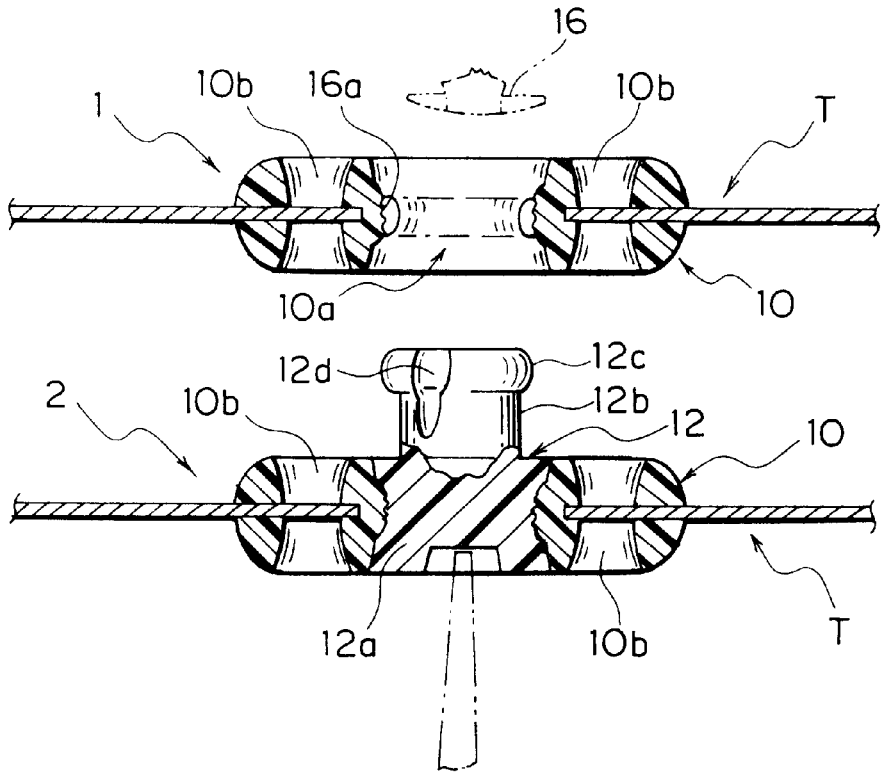
FIG. 5 is an explanatory diagram of a molded-gate-removing mechanism when the male fastening member is fit to the female fastening member just molded.

According to this embodiment, in addition to the above-mentioned excellent functions, a special function which could not be expected to this kind of a conventional fastener with tape can be provided by its particular molding method. As apparent from FIG. 2, according to this embodiment, the molded gate 16 has a wedge-shape as a whole so as to minimize a sectional area of a joint portion of the molded gate 16 to the base portion 10. As a result, when the male engaging portion 12 is inserted into the opening 10*a* of the base portion 10, as shown in FIG. 5, the molded gate 16 extending across the opening 10*a* so as to be integral therewith is broken and removed easily by an insertion force of the aforementioned male engaging portion 12. By applying such a gate configuration, not only trimming at succeeding process, which is necessary in the invention of the aforementioned U.S. patent, can be omitted for shipment of the fastener products in a state where the male and female fastening members engaged with each other, but also the molded gate 16 is automatically removed at the same time when the male and female fastening members are engaged with each other.

According to this embodiment, the concave portions 10*c* on a part of the inner peripheral face of the opening 10*a* are formed so as to be dented toward two molding holes 10*b* of four molding holes 10*b* formed by the tape-supporting members, such that the molded gate 16 is placed on the same straight line as the two molding holes 10*b*. When the base portion 10 is used as a female fastening member 1 as in this embodiment, the concave portion 10*c* has burrs (gate burrs 16*a*) on the bottom face 10*c*' after the molded gate 16 is broken and removed as described above. However, when the engaging head portion 12*c* of the male engaging portion 12 is engaged with and disengaged from an opening peripheral face 10*a*' of the base portion 10 as the female engaging portion, the burrs can be prevented from being left on the opening peripheral face 10*a*' which will make a direct contact with the engaging head portion 12*c*. Further, the trimming on a succeeding process as mentioned in the U.S. patent can be omitted. Additionally, the gate burrs 16*a* become difficult to be seen from outside. Further, because the concave portion 10*c* partly interrupts a ring-shape continuity of the opening peripheral face 10*a*', the engagement/disengagement of the male fastening member 2 can be smoothly done.

Further, the joints of the gate molded portions 16 to the bottom face 10*c*' of the concave portions 10*c* are substantially in the center of the same bottom face 10*c*' and the molded gate 16 is formed on the same straight line connecting the center of the opening 10*a* with the molding holes 10*b*. Therefore, an introduction pressure of molten resin into the mold cavity is directed positively to the mounting-hole peripheral portion of the tape T and at the same time, positively to the tape supporting members (pins) protruding into the front and rear surfaces of the tape T in the cavity. This enables the molten resin to be spread quickly to the entire peripheral portion of the mounting holes 3 of the tape T and as a result, appropriate waving can be realized at the peripheral portion of the mounting holes of the tape T as mentioned in the aforementioned U.S. patent specification.

On the other hand, in case where the base portion 10 is used as a base portion of the male fastening member 2, the concave portion 10*c* is very effective. That is, in the male fastening member 2 shown in FIGS. 3 and 4, mounting of the male engaging portion 12 to the base portion 10 is carried out by integral molding. Because a part of the male engaging portion 12 buries the concave portion 10*c* when the male engaging portion 12 is molded, locking function between the base portion 10 and male engaging portion 12 is added so that the fixing strength is further improved. Even if the molded gate 16 is left in the opening 10*a* of the base portion 10, the male engaging portion 12 can be molded to the opening 10*a*. Further, because the molded gate 16 is buried inside the male engaging portion 12 as an aggregate, the fixing strength thereof is improved. In this case, because the molded gate 16 is not broken and removed from the opening 10*a*, the molded gate 16 does not have to be wedge-shaped as mentioned above.

Figure 6:
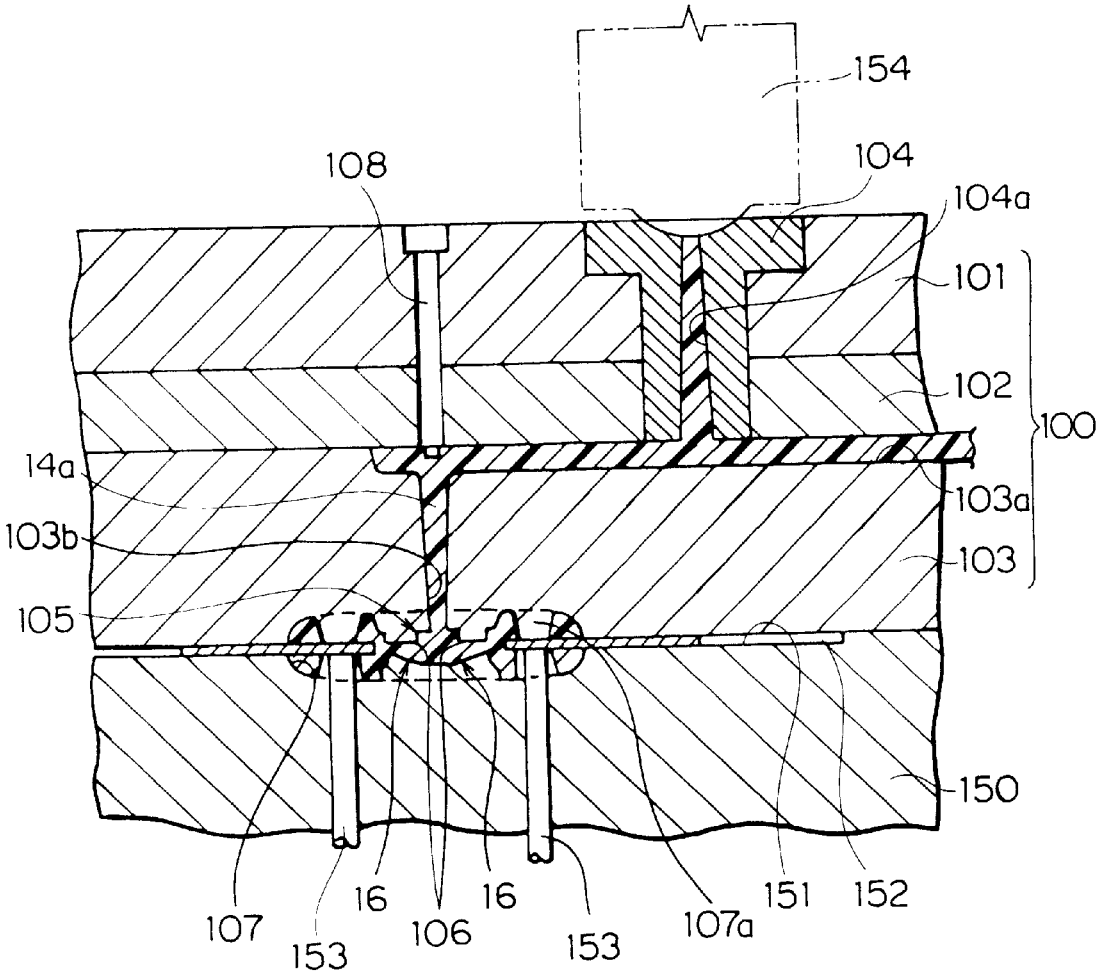
FIG. 6 is a partial sectional view showing an inner structure of a molding die for the base portion of the present invention and a molding mechanism thereof.

FIG. 6 shows an example of a molding die when the base portion 10 is molded integrally on the tape T. In this example, the molding die comprises a first die (movable die) 100 movable vertically and a second die (fixed die) 150. The first die 100 is composed of three plates 101–103 movable vertically toward each other. The upper plate 101 is a movable mounting plate provided to be vertically movable with respect to a base frame by a lift means (fluid-pressure cylinder or the like) (not shown), and the intermediate plate 102 and the bottom plate 103 are movable vertically and independently relative to the upper plate which is the movable mounting plate 101. On the other hand, the second die 150 is composed of a single independent plate fixed to machine base.

A substantially upper half of a sprue bush 104 composing a sprue 104*a* is firmly engaged in and fixed in the movable mounting plate 101 according to a predetermined method, and a substantially lower half of the sprue bush 104 is engaged slidably in an engaging hole of a stripper plate 102 which is the intermediate plate. In the lower plate 103, a runner 103*a* communicating with the sprue 104*a* is formed perpendicular to a feed direction of the tape T. Further, a sub-runner 103*b* extending vertically downward is formed at an end of the runner 103*a*. A runner lock pin 108 is mounted on an extending line of the sub-runner 103*b* in the movable mounting plate 101 and the stripper plate 102.

At a bottom end of the sub-runner 103*b* is formed with a gate 106 extending horizontally in a linear shape via a resin reservoir portion 105, at a parting surface 151 of the fixed die 150 which is the second die. In this embodiment, as shown in FIG. 6, the aforementioned gate 106 comprises two pieces extending to the left and right in a linear shape from the resin reservoir portion 105, and each gate piece has a wedge shape and is a pin point gate formed in a wedge shape, in which its section decreases gradually from the resin reservoir portion 105 toward an end thereof. The resin reservoir portion 105 of this embodiment serves as a molten-resin-introduction portion of the present invention and the gate 106 serves for a molten resin guide path of the present invention. Therefore, the molten resin introduction portion to the base-portion-molding cavity 107 of the present invention is each end portion of the gate 106.

The end portions of the gate 106 communicate with the molding cavity 107 for the base portion 10 which is a female fastening member 1. In this embodiment, the molding cavity 107 is formed in the bottom plate 103 and the fixed die 150 which is the second die via the parting surface 5 and the resin reservoir portion 105 is also formed in the fixed die 150 via the parting surface. Further, a tape insertion path 152 extending in the feed direction of the tape T is formed around the cavity 107 of the fixed die 150.

The base portion forming cavity 107 is a molding space having a flower-shape configuration. A center portion thereof in which the gate 106 including the resin reservoir portion 105 exits is formed in a solid portion as shown in FIGS. 4 and 5. Inside the ring-shaped space of the base portion forming cavity 107 are four pairs of pins 107*a* which are the tape supporting members provided so as to protrude from above and below toward the inside of the cavity, the four pairs of the pins 107*a* having a deflection of phase of 90°. A gap between the upper and lower pins 107*a* of each pair is set to be a sufficient dimension for holding the tape T. Further, according to this embodiment, insertion holes for eject pins 153 are formed in the fixed die 150 along an axis of each of the pins 107*a* opposing the gate 106, such that each eject pin 153 moves slidably in a vertical direction in the pin 107*a* by an eject-pin-lift means (not shown).

Further, in this embodiment, a joint portion between the gate 106 and the cavity 107 is placed on a line extending between an opposing gap of each of two pairs of the upper and lower pins 107*a* and a center of the resin reservoir portion 105, and the gate 106 is directed to the mounting hole periphery of the tape T. The joint portion protrudes in the cavity 107 such that the concave portions 10*c* are formed to be dented in the direction of an outer diameter of a circle of the opening 10*a* of the base portion 10.

Next, steps for producing the base portion 10 by a molding apparatus having a molding die according to this embodiment having such a structure will be described below. First, as shown in FIG. 6, with the entire molding die closed, an injection nozzle 154 of an injector unit is brought into contact with the sprue bush 104 and then resin injection is carried out. Molten resin to which the aforementioned inorganic filler is added is introduced into the base-portion-molding cavity 107 through the sprue 104*a*, the runner 103*a*, the sub-runner 103*b*, the resin reservoir portion 105 and the gate 106.

Upon this injection, the molten resin material introduced into the cavity 107 flows from an end of the gate 106 toward the periphery of the mounting hole 3 in the tape T. After the molten resin branches to the front and rear surfaces of the tape T, so that the molten resin circulates around the pins 107*a* which are disposed to oppose each other from above and below, thereby being charged in the entire cavity. At this time, the portion other than that held by the pins 107*a* at the periphery of the mounting hole 3 of the tape T is slightly waved by fluid pressure of the resin and buried inside the molten resin material.

If the injected resin material containing the inorganic filler is hardened, the movable mounting plate 101 and the stripper plate 102 are lifted up together, so that the molded runner 14 is separated from the lower plate 103 together with the molded sub-runner 14*a* while being supported by the runner lock pin 108. At this time, a bottom end of the molded sub-runner 14*a* is broken and separated from an upper end of a molded resin reservoir 15 by a separating force. Next, the stripper plate 102 is moved slightly so as to release supporting of the molded runner 14 by the runner lock pin 108, so that the molded runner 14 is released from the molding die with a molded sprue.

When this release is completed, the lower plate 103 is moved upward so as to open the molding die. Substantially at the same time, the eject pins 153 are moved slightly upward so as to push the tape T exposed in the middles of the molding holes 10*b* formed by the tape supporting pins 107*a,* and then the base portion 10 is pushed out of the molding die together with the molded gate 16. At this time, in the base portion 10, the molded sub-runner 14*a* is broken and separated as indicated by a phantom line in FIG. 2. Because the molded gate 16 left in the base portion 10 is connected to the bottom faces 10*c*' of the concave portions 10*c* formed in the opening 10*a* of the base portion 10 via a minute portion, as described previously, it is automatically broken and removed when the engaging head portion 12*c* of the male fastening member 2 is engaged.

A breaking burrs (gate burrs 16*a*) of the molded gate 16 formed at this breaking time is difficult to see from outside because it is formed on the bottom face 10*c*' of each concave portion 10*c*. Further, partly because that breaking face is not formed on the inner peripheral face of the opening 10*a* which the engaging head portion 12*c* of the male fastening member 2 is directly engaged with and disengaged from, and partly because the circular inner peripheral face 10*a*' is divided by the concave portions 10*c,* engagement and disengagement of the male fastening member 2 is made smoothly.

In this embodiment, a molding die in which four pieces of the gate 106 are formed in a cross shape in a resin reservoir portion 105 may be used. In this case, four resin introduction portions for the base-portion-molding cavity 107 are formed so that they are directed toward the mounting hole periphery of the tape T. Therefore, as compared to the above-described embodiment, the resin flow is made smoother thereby forming of the base portion 10 integrally with the tape T in a stabilized manner. Further, because the inner peripheral face 10*a*' of the substantially circular opening 10*a* is divided equally by the concave portion 10*c* at four points in the circumferential direction. Thus, engagement/disengagement relative to the male fastening member 2 is made smoother.

Figure 7:
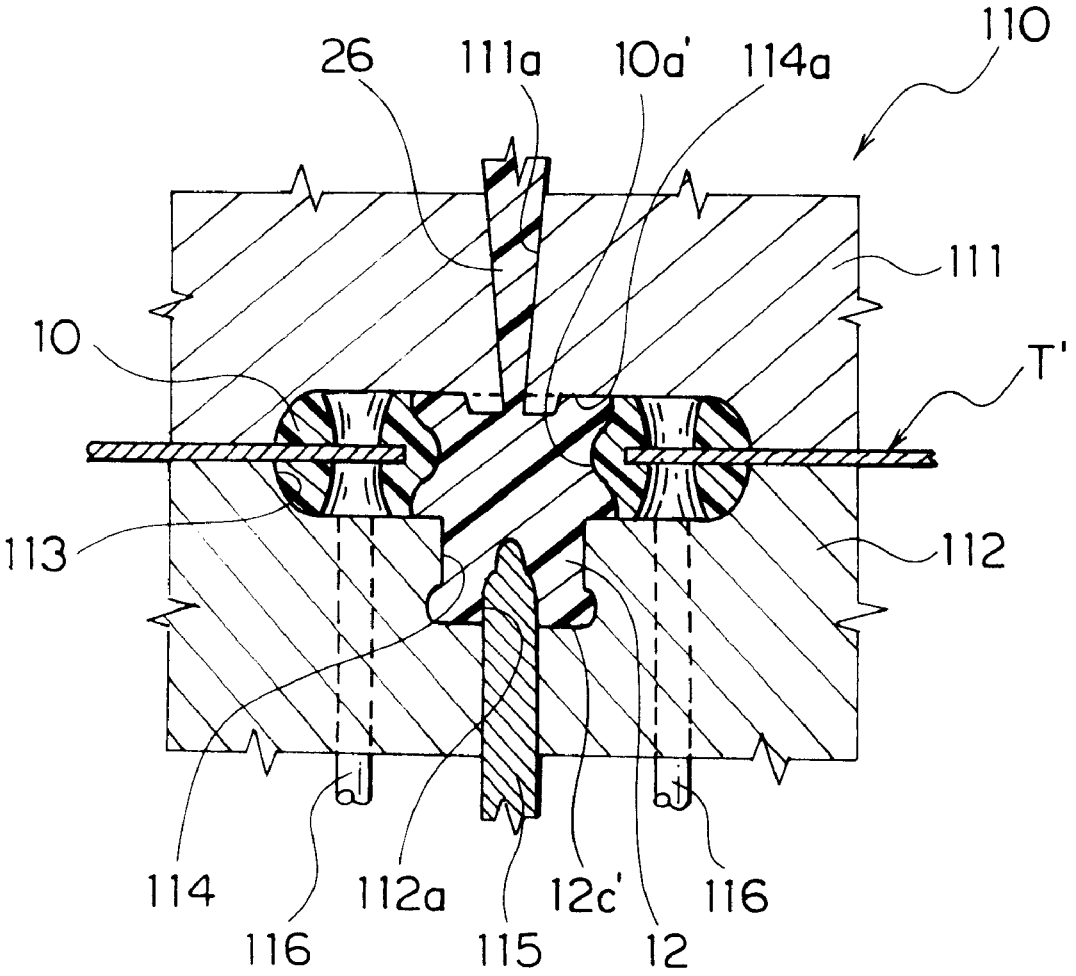
FIG. 7 is a partial sectional view showing a structure of a molding die for molding an engaging portion integrally in an opening of the base portion and a molding mechanism thereof.
Figure 8:
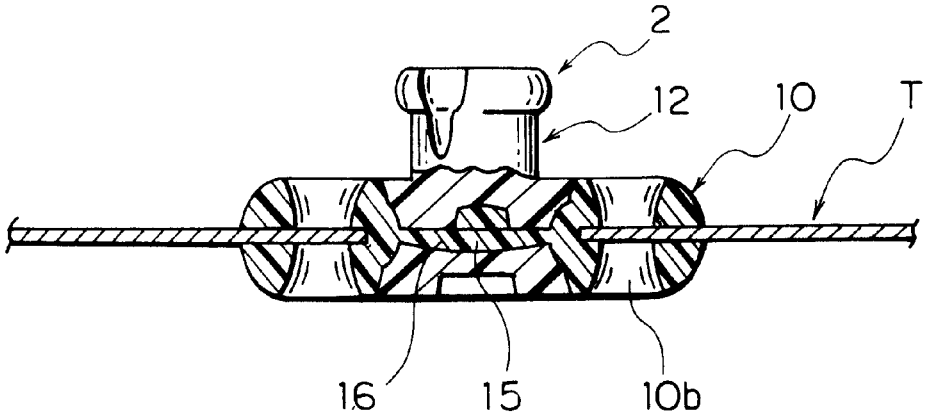
FIG. 8 is a sectional view showing an example of the male fastening member of the present invention, in which a molded gate is buried inside thereof.

FIG. 7 shows major parts of a molding die for molding the male fastening member 2 using a tape T' with the base portion in which the base portion 10 having the above-mentioned structure is molded integrally on the tape T. In this embodiment, the aforementioned base portion 10 composes the base portion of the present invention, and the male engaging portion 12 molded integrally on the inner peripheral face 10*a*' of the opening 10*a* composes an engaging portion.

In the same Figure, reference numeral 110 denotes an injection molding die for molding the male engaging portion, and the molding die 110 comprises a movable die 111 and a fixed die 112 likewise the injection die for molding the base portion as described previously. At a parting surface between the movable die 111 and the fixed die 112, there is formed a space portion 113 for accommodating a tape and a base portion to which the base portion 10 is molded integrally. Continuously to the space portion 113 for accommodating the tape with base portion, there is formed a male-engaging-portion-molding cavity 114 for molding the column portion 12*b* and the engaging head portion 12*c* and burying a central opening 10*a* of the base portion 10 with a base portion 12*a*.

Thus, a gate 111*a* communicating with a runner (not shown) is formed in the movable die 111 such that it communicates with the center portion of a molded base portion 114*a* of the male-engaging-portion-molding cavity 114. A sliding path 112*a* for a sliding core 115 is formed in the fixed die 112 to divide the column portion 12*b* and the engaging portion 12*c* of the male engaging portion 12 into two parts. In this Figure, the sliding path 112*a* is formed so as to be slidable in a direction in which the sliding core 115 go across the fixed die 112. In the same Figure, eject pins 116 are provided so as to be lifted up and down at portions accommodating the base portion 10 and which is inside of the space portion 113 for accommodating the tape with base portion 10 in the fixed die, and the eject pins 116 contact with an outer surface of the base portion 10.

The tape T' with the base portion in which the base portion 10 is molded integrally on the mounting-hole peripheral portion of the tape T is inserted and set in the injection molding die having the aforementioned structure. The male fastening member 2 molded by the injection molding die as shown in FIG. 7 is different from the aforementioned base portion 10 having a female fastening member structure in that the male engaging portion 12 is molded integrally in the opening 10*a* of the base portion 10. That is, the opening 10*a* is closed by the base portion 12*a* of the male engaging portion 12, in which the column portion 12*b* and engaging head portion 12*c,* which are to be engaged with and disengaged from the opening 10*a* of the base portion 10 of the female fastening member, are provided so as to protrude on a surface of the base portion 12*a* of the male engaging portion.

The male engaging portion 12 is composed of the column portion 12*b* standing directly from the base portion 12*a* filling the opening 10*a* of the base portion 10 and the engaging head portion 12*c* provided at an end of the column portion 12*b*. This male engaging portion 12 is divided into two parts by a dividing groove 12*d* extending from the vicinity of the standing end of the column portion 12*b* up to the engaging head portion 12*c*. A shape of the dividing groove 12*d* is determined by a longitudinal sectional shape of the sliding core 115. As apparent from FIG. 7, the bottom face of the dividing groove 12*d* is arc-shaped and a small width portion and a large width portion are formed in a continuous shape via a arc-shaped stepped portion, extending from the arc bottom face up to an end of the engaging head portion 12*c*. As for the above-mentioned shape of the dividing groove 12*d* according to this embodiment, a thickness of a bulging portion 12*c*' in an bulging direction of the engaging head portion 12*c* is substantially the same as a thickness of the groove bottom portion in the diameter direction and the width of the groove bottom portion is small. Therefore, an influence of shrinkage after the molding is small, and even after the molding, a part of the column portion 12*b* divided into the left and right and the engaging head portion 12*c* stand substantially in parallel to each other.

On the other hand, when a sectional shape of the dividing groove is simply rectangular like a conventional dividing groove, the thickness of the bulging portion in the bulging direction of the engaging portion is larger than that of a part of the column portion divided into the left and right and that of the engaging portion, and the groove width of the groove bottom portion is relatively larger as compared to the other parts. Thus, the engaging portions divided into the left and right are deformed by shrinkage or the like in such a direction that the divided parts come close to each other. This causes weakening of an engaging force of the male fastening member 12 with a mating female fastening member 1, which means that the engaging force would become weaker as compared to this embodiment. Further, a shape of the male engaging portion of this embodiment allows a larger elastic deformation as compared to the conventional dividing shape, so that engagement with/disengagement from the female fastening member 1 is facilitated and a desired engaging/disengaging force can be ensured.

If the tape T' with the base portion is inserted in the space portion 113 for accommodating the tape with the base portion formed in the movable die 111 and the fixed die 112 in order to mold the male engaging portion 12 having the aforementioned structure integrally on the opening peripheral portion of the base portion 10 and then the molding die is closed, molten resin material having the same composition as the base portion 10, to which the inorganic filler is added, is injected at a predetermined injection amount and introduced into the male-engaging-portion-molding cavity 114 via the aforementioned gate 111*a*. If the molten resin material introduced to the male-engaging-portion-molding cavity 114 is cooled and hardened, the movable die 111 ascends so that the molded gate 26 is broken and removed from the molded male engaging portion 12.

Next, at the same time when the movable die 111 begins to be opened before the male fastening member 2 is pushed out of the fixed die 112 by the eject pins 116, the sliding core 115 is also actuated. If the sliding core 115 is released from the cavity portion for molding the male engaging portion 12, the eject pins 116 are actuated so as to push the male fastening member 2 composed of the base portion 10 and the male engaging portion 12 out of the fixed die 112. When pushed out, a part of the column portion 12*b* and the engaging head portion 12*c* having the dividing groove 12*d* in the middle are deformed elastically such that the dividing groove 12*d* is narrowed, thus the male fastening member 2 is pushed out of the dies easily.

According to this embodiment, the base portion 10 and the male engaging portion 12 are made of resin material containing the inorganic filler having the same composition. In this case, because the stiffness and the elasticity of the molded bodies change depending on an addition amount of the filler, if the base portion 10 and the male engaging portion 12 are molded of the resin material containing the inorganic filler having the same compositions as described in this embodiment, a stiffness necessary for the base portion 10 to be molded integrally on the tape T with a desired fixing strength and an elasticity necessary for the male engaging portion 12 to have a desired engaging force must be satisfied at the same time. Thus, an experiment was carried out to see the amount of filler which satisfies both the conditions. As a result, it has been made evident that the amount of the inorganic filler is preferably in a range of 8–15 wt % with respect to a total weight of the resin material, more specifically when nylon 6 is used as in this embodiment, in a range of 10–15 wt %.

It is also possible to provide the base portion 10 with a desired stiffness and the male engaging portion 12 with a desired elasticity by adding different amounts of the inorganic fillers to the base portion 10 and the male engaging portion 12, which is possible only in the embodiment. In this case, the amount of the inorganic fillers may be determined appropriately in a range at least 15 wt % for the base portion 10 and in a range of 4–15 wt % for the male engaging portion 12.

Further, by adding the different materials of the inorganic fillers to the base portion 10 and the male engaging portion 12, it is possible to provide the base portion with a predetermined stiffness and further the male engaging portion 12 with an appropriate elasticity. For example, if fiber-like kalium-titanate inorganic filler having an average fiber diameter of 0.3–0.6 $\mu$m and a length of 10–20 $\mu$m is added to the resin material (nylon 6) of the base portion 10 at a rate more than 15 wt %, and metallic (stainless) fine powder of 5–7 wt % is added to the resin material (nylon 6) of the male engaging portion 12, the stiffness of the base portion 10 is 30,000 kg/cm$^2$ or more and the elasticity of the male engaging portion 12 is about 20,000 kg/cm$^2$. As a result, as this kind of the fastener, a high-quality snap fastener with tape has been obtained.

Figure 9:
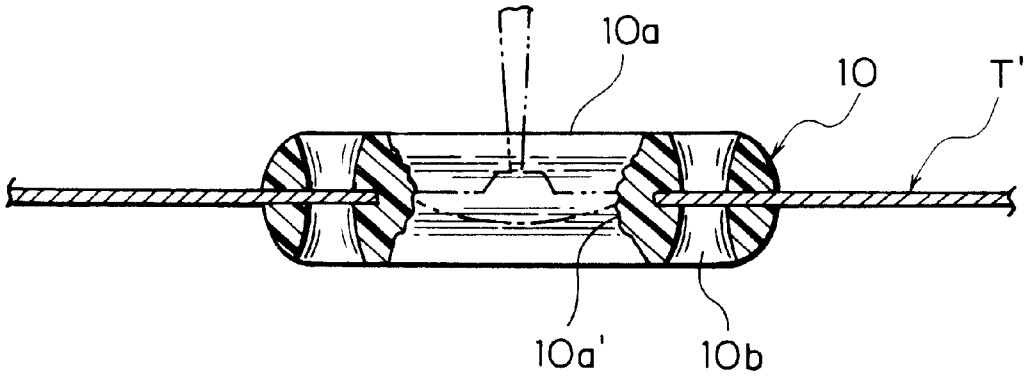
FIG. 9 is a sectional view showing an example of a base portion in which unevenness is provided on an inner peripheral face of the opening.

For this embodiment, a case in which the male engaging portion 12 is molded integrally on the base portion 10 has been described. However, if the base portion 10 has no structure as a female fastening member, an engaging portion which is to be molded integrally on the base portion 10 may be a female engaging portion 11. FIGS. 9 and 10 show that that example. FIG. 9 is a sectional view when the base portion 10 is molded integrally on a peripheral portion of the mounting hole 3 of the tape T and FIG. 10 is a sectional view of a fastener with tape, obtained by molding the female engaging portion 11 integrally on the opening 10*a* of the base portion of the tape T'. In a description below, the like reference numerals are given to members and components corresponding to the above embodiment.

In the base portion 10 of this embodiment, which is different from the above described embodiment, the inner peripheral face 10*a*' of the opening 10*a* is not formed in a form of an engaging face relative to the mating male fastening member 2 but a plurality of unevennesses are formed on the inner peripheral face 10*a*'. As shown in FIG. 10, when the female engaging portion 11 is formed, a part of the female engaging portion 11 is formed along the unevenness surface so as to form a strict fixing interface. In this embodiment also, the base portion 10 is molded based on substantially the same configuration and arrangement of the sprue and gate as the embodiment for molding the aforementioned male engaging portion 12, as indicated by a phantom line of FIG. 9.

Upon molding such a female engaging portion 11, it is preferable to add an appropriate amount of the inorganic filler to the resin material as a molding material. The amount of the inorganic addictive may be determined appropriately in the above described range. To eliminate wearing due to repeated engagement or disengagement with/from the mating male engaging portion 12, it is preferable to use the same kind of organic resin for the resin material and also the same kind of inorganic filler as of the male engaging portion 12.

As is the same in the above described embodiments, when the female or male engaging portion 11 or 12 is mounted to the base portion 10, the base portion 10 and the respective engaging portions 11 or 12 can be made of different color materials, thereby making it possible to meet various demands. In case where the base portion 10 and the female or male engaging portion 11 or 12 are molded in different colors, usually, pigment or the like is mixed with the respective resin material. However, if a material which can be dyed is selected as a base portion, after the base portion 10 is molded on the tape T, it can be dyed together with the tape T with the same dye. Alternatively, if a dye stuff which does not dye the tape T but dyes the base portion is selected, the colors of the tape T and the base portion 10 can be made different. If the base portion 10 can be dyed as such, by producing a large number of tapes with base portions in which the base portion 10 having no color is molded integrally on the tape T, the base portions 10 of a necessary number of the tapes with base portion can be dyed, thereby enabling efficient production and product control.

Figure 11:
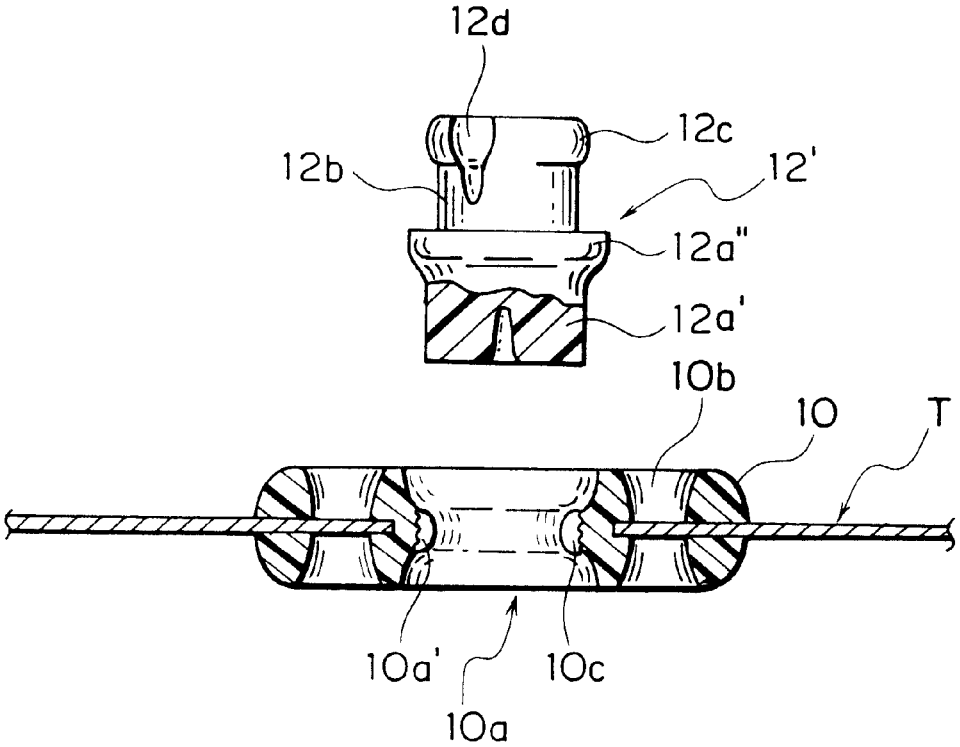
FIG. 11 is a sectional view showing a condition before the engaging portion is mounted to the base portion molded independently partially with side view.
Figure 12:
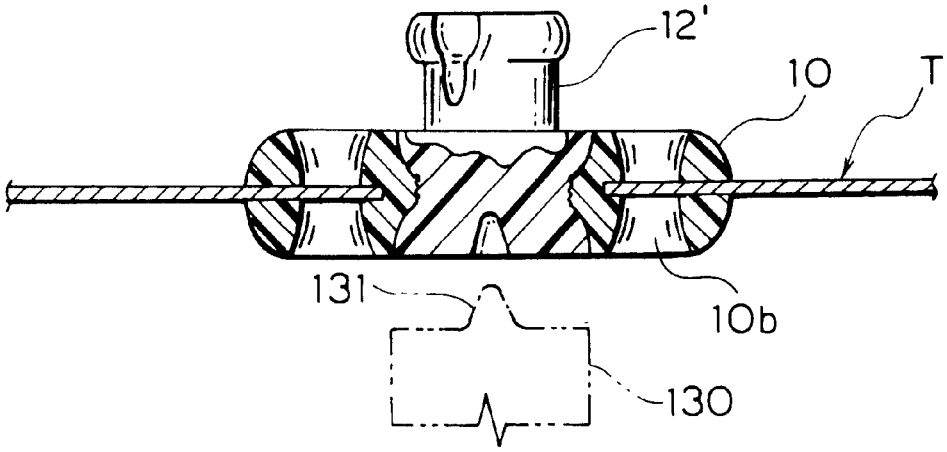
FIG. 12 is a sectional view showing a state of the fastener with tape in which the male engaging portion is mounted to the base portion by thermal deformation and a mounting mechanism thereof.

Although, in the above respective embodiments, examples in which the female or male engaging portion 11 or 12 is molded integrally to the base portion 10 has been described, other mounting methods are possible other than the method for molding integrally the engaging portion to the base portion. FIGS. 11 and 12 show an example of such mounting method. According to this example, a male engaging portion 12', similar to the above male engaging portion, having a base portion 12*a*', a column portion 12*b* and an engaging head portion 12*c* are molded first. Although this male engaging portion 12' is substantially equal to the male engaging portion 12, a blind hole narrowing gradually is formed in a center of an end face of the base portion 12*a*'. After the male engaging portion 12' molded preliminarily in the above manner is inserted into an opening 10*a* of a base member 10, a conical protruding portion 131 of a heating body 130 as indicated by the phantom line of FIG. 12 is inserted and pressed into the blind hole in the center of the end face of the male engaging portion 12' and pressed therein. As a result, the end face of the male engaging portion 12' is heated and deformed by this pressure and heat, so that a diameter thereof is expanded and become an outer shape along the opening 10*a* of the base portion 10. Consequently, the male engaging portion 12 is engaged in the opening 10*a* together with a flange portion 12*a*" of the base portion 12*a'*.

Further, as aother mounting method, the male engaging portion 12' having the same shape as described previously is formed preliminarily and the male engaging portion 12' is inserted into the opening 10*a* of the base portion 10. Next, the column portion 12*b* and engaging head portion 12*c* of the male engaging portion 12' are inserted into an insertion hole for the engaging head portion 12*c* formed in an anvil (not shown) so that the anvil comes into contact with a flange portion 12*a*" of the base portion 12*a*'. After that, a ultrasonic horn (not shown) is inserted into a blind hole in the center of an end face of the base portion 12*a*' and then ultrasonic wave is generated so as to deform the base portion 12*a*'. As a result, an interface between the inner peripheral face of the opening 10*a* of the base portion 10 and an outer peripheral face of the base portion 12*a*' is melted so as to fuse both the components together.

According to still another mounting method (not shown), a male engaging portion 12 whose base portion 12*a* has a shape for fittedly engaging with an opening 10*a* of a base portion 10 is formed preliminarily and then an interface between the base portion 12*a* and the opening 10*a* is fused together by high frequency wave. As still another method, adhesive agent may be coated on a peripheral face of the base portion 12*a* of the male engaging portion 12 or an inner peripheral face of the opening 10*a* of the base portion 10, and then the base portion 12*a* of the male engaging portion 12 may be inserted into the opening 10*a* so that the both are bonded together by the adhesive agent.

Figure 13:
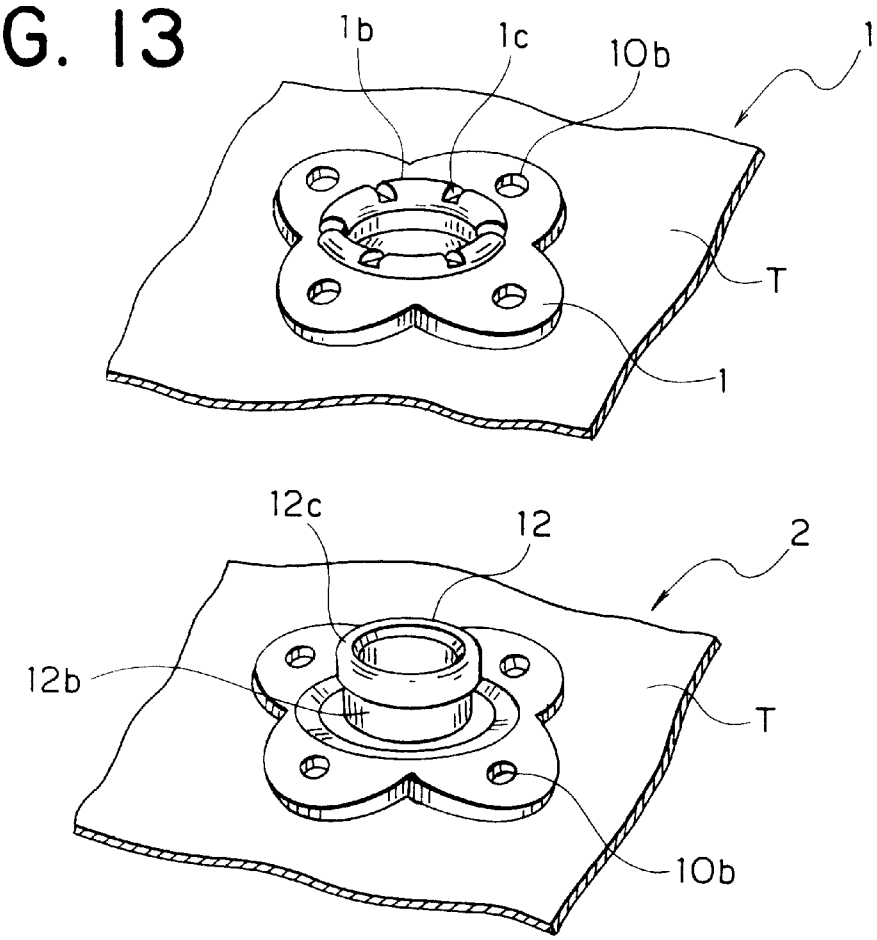
FIG. 13 is a partial perspective view showing other embodiment of female and male fastening member with tape according to the present invention.
Figure 14:
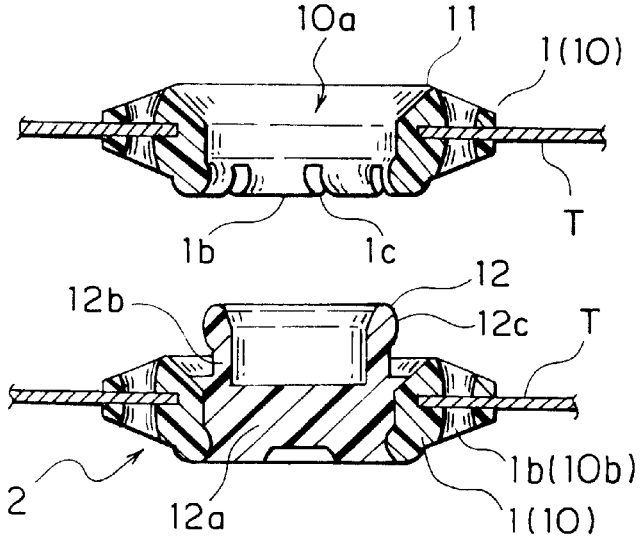
FIG. 14 is a sectional view of the female and male fastening member.

FIGS. 13 and 14 show an embodiment of a fastener with tape having another engaging structure according to the present invention. A female fastening member 1 of the fastener with tape of this embodiment can be used as a base portion of the present invention like the embodiment shown in FIG. 2.

As seen from the illustrated, in a central opening 10*a* of a female fastening member 1 (base portion 10), an engaging portion 1*b* which engages with/disengages from a mating male fastening member 2 is formed along an inner peripheral edge of one of front and rear surface thereof. This engaging portion 1*b* bulges from an inner peripheral face thereof toward the inside and a center of a central opening 10*a,* and a plurality of cutout portions 1*c* are formed with a predetermined interval in a circumferential direction. Because the engaging portion 1*b* is elastically deformed slightly in the diameter direction because of this cutout portion 1*c,* engagement with/disengagement from the engaging head portion 12*c* of a mating fastener which will be described later can be achieved smoothly.

The male fastening member 2 is made using the aforementioned female fastening member 1 as a base portion of the present invention. That is, as seen in FIG. 14, according to the method already described, the male engaging portion 12 is molded integrally to the central opening 10*a* of the female fastening member 2. Upon this molding, a part of the male engaging portion 12 permeate into the cutout portions 1*c* formed in the female fastening member 1 so that the both are integrated together. Therefore, fixing strength between the female fastening member 1 which is a base portion and the male engaging portion 12 increases, so that a predetermined fixing strength can be obtained even if they are made of resins having a low affinity.

As described above, the cutout portions 1*c* are formed in the opening 10*a* of the female engaging portion 11 so that the opening 10*a* of the female engaging portion 11 is allowed to be elastically deformed. Therefore, the column portion 12*b* and the engaging head portion 12*c* of the male engaging portion 12 are only made in a hollowed cylindrical form, and the engaging head portion 12*c* is made to bulge outward. Thus, although a dividing groove 12*d* is not formed as in the previously mentioned male engaging portion 12, smooth engagement/disengagement between the female fastening member 1 and male fastening member 2 can be achieved, and a sufficient engaging/disengaging force for actual application can be ensured. Further, because no dividing groove is formed, there is no risk of accidental catching string or hair upon engagement or disengagement.

Figure 15:
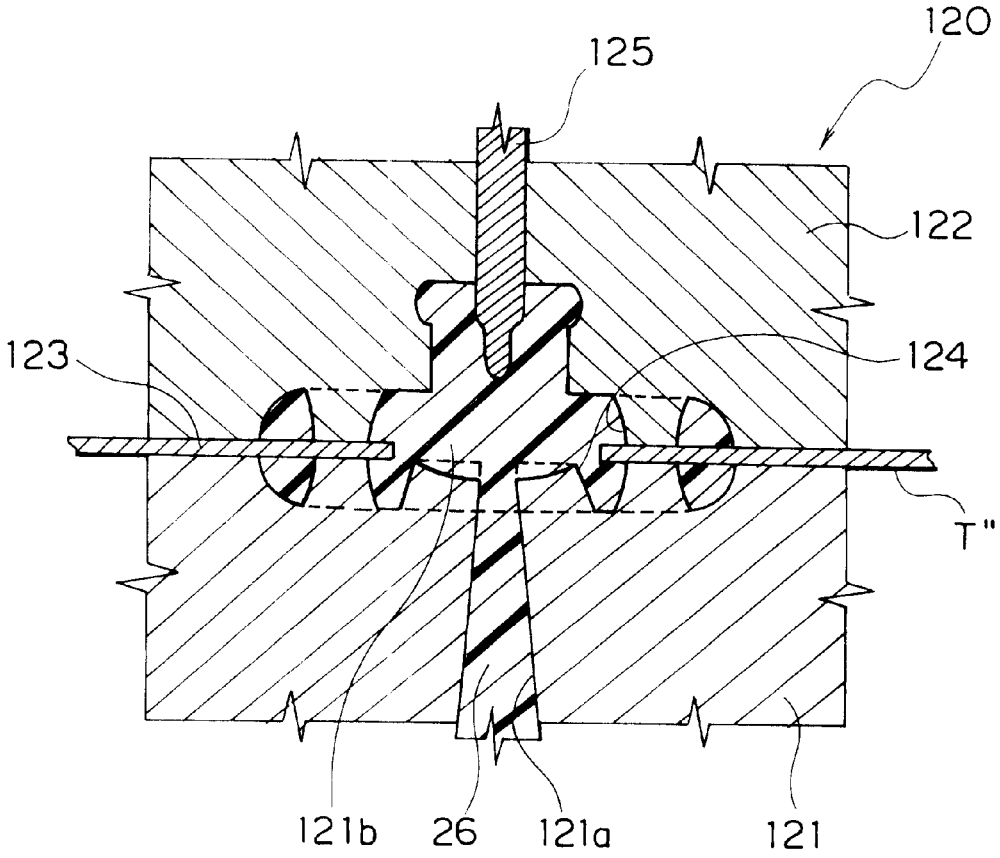
FIG. 15 is an explanatory diagram of a molding die for molding the base portion and engaging portion of the male fastening member according to other embodiment of the present invention, at the same time and a molding process thereof.

FIG. 15 shows a molding condition in which a base portion and an engaging portion of the fastener with tape according to the present invention are simultaneously molded integrally by ordinary insert molding which is used in the above-mentioned U.S. patent and European Patent. In this embodiment, a male snap fastener is molded.

In this Figure, reference numeral 120 denotes an injection molding die for the male fastening member, and this molding die contains a male-fastening-member-molding cavity 124 in which the base-portion-molding cavity is combined with a male-engaging-portion-molding cavity. In the Figure, reference numerals 121 and 122 indicate a movable die and a fixed die respectively. Because the other structure members are the same as the die for the male engaging portion as shown in FIG. 7, a description thereof is omitted here.

To integrally mold a male fastening member to a tape using the molding die 120 having such a structure, the tape T" is inserted into a tape-accommodating-space portion 123 formed in the movable die 121 and the fixed die 122, and the molding die is closed. Then, molten resin material, which is added with the inorganic filler of 8–15 wt % with respect to a total weight of the resin material, is injected at a predetermined injection amount and introduced to the male-fastening-member-molding cavity 124 through a sub-runner 121*a* and a gate 121*b*. After the molten resin material introduced to the male-fastening-member-molding cavity 124 is cooled and hardened, the movable die 121 ascends so that a molded runner and a molded gate 26 are broken and removed.

Next, at the same time when the movable die 121 begins to be opened and before the male fastening member 2 is pushed out of the fixed die 122 by eject pins (not shown), a sliding core 125 is actuated. If the sliding core 125 is released from a portion of the male-fastening-member-molding cavity portion for the male engaging portion 12, the eject pins (not shown) are actuated so as to push the male fastening member 2 out of the fixed die 122. At the time of this push-out, an engaging head portion 12*c* of the male fastening member 2 is deformed elastically so that its dividing groove 12*d* in a part of a column portion 12*b* and the engaging head portion 12*c* is elastically narrowed and then, the male fastening member 2 is pushed out of the die easily.

Only typical embodiments of the present invention have been described above, and it will be easily understood that the present invention may be modified in various manners within a scope and spirit of the present invention.

What is claimed is:

1. A fastener with tape having fastening members of synthetic resin molded integrally on front and rear surfaces of the tape, wherein each fastening member comprises sythetic resin material to which fine organic filler is added, wherein an amount of said inorganic filler added is 4–30 wt % with respect to a total weight of the synthetic resin material.

2. A fastener with tape according to claim 1, wherein a melting point of the synthetic resin material to which said inorganic filler is added is 180° C. or higher, elasticity thereof is about 15,000–45,000 kg/cm$^2$ and stiffness thereof is 25,000 kg/cm$^2$ or more.

3. A fastener with tape according to claim 1 or 2, wherein said inorganic filler is in fiber state and the fiber length thereof is 0.1 mm or less.

4. A fastener with tape according to claim 1, wherein an amount of said inorganic filler to be added to the sythetic resin material is 5–16 wt % with respect to the total weight of the synthetic resin material.

5. A fastener with tape according to claim 1, wherein each of said fastening members is composed of a base portion molded integrally on front and rear surfaces of the tape so as to enclose an entire peripheral portion of a mounting hole in the tape and an engaging portion which engages with and disengages from a mating fastening member, said engaging portion being molded at the same time when said base portion is molded so that each of said engaging portions is integral with said base portion.

6. A fastener with tape according to claim 5, wherein an amount of said inorganic filler added is 8–15 wt % with respect to the total weight of the synthetic resin material to which said inorganic filler is added.

7. A fastener with tape according to claim 1, wherein each of said fastening members includes a base portion molded integrally on front and rear surfaces of the tape so as to enclose an entire peripheral portion of a mounting hole in the tape, said base portion having an opening in a center thereof, and an engaging portion which is mounted integrally to said base portion at least along an inner peripheral face of said opening of said base portion and which engages with and disengages from a mating fastening member.

8. A fastener with tape according to claim 7, wherein said engaging portion is mounted integrally by insert molding after said base portion is molded.

9. A fastener with tape according to claim 7 wherein said base portion and said engaging portion are molded independently, and said base portion and said engaging portion being mounted with a mounting means.

10. A fastener with tape according to any of claim 7 to 9, wherein synthetic resin materials of mating engaging portions of said fastening members are made of the same organic resin materials.

11. A fastener with tape according to claim 10, wherein an addition amount of said inorganic filler to said base portion is 15 wt % or more with respect to a total weight of the synthetic resin material, and an addition amount of said inorganic filler to said engaging portion is 4–15 wt % with respect to the total weight of the synthetic resin material.

12. A fastener with tape according to claim 10, wherein inorganic fillers to be added to said base portion and said engaging portions are different from each other.

* * * * *